US007516638B2

(12) United States Patent
Roush et al.

(10) Patent No.: US 7,516,638 B2
(45) Date of Patent: Apr. 14, 2009

(54) PORTABLE HAND TOOL

(75) Inventors: Timothy J. Roush, Flint, MI (US); Michael C. Clark, Columbiaville, MI (US)

(73) Assignee: Tapco International Corporation, Wixom, MI (US)

( * ) Notice: Subject to any disclaimer, the term of this patent is extended or adjusted under 35 U.S.C. 154(b) by 139 days.

(21) Appl. No.: 11/749,438

(22) Filed: May 16, 2007

(65) Prior Publication Data

US 2007/0266839 A1 Nov. 22, 2007

Related U.S. Application Data

(60) Provisional application No. 60/800,759, filed on May 16, 2006.

(51) Int. Cl.
*B21D 7/02* (2006.01)

(52) U.S. Cl. ..... 72/214; 72/211

(58) Field of Classification Search ..... 72/105, 72/124, 210, 211, 214, 220, 237, 247, 446, 72/478, 479, 480, 481.3, 481.4, 481.6, 481.7, 72/481.8

See application file for complete search history.

(56) References Cited

U.S. PATENT DOCUMENTS

| | | | | |
|---|---|---|---|---|
| 2,471,445 | A | 5/1949 | Nicholas | |
| 4,825,676 | A * | 5/1989 | Diggins | 72/211 |
| 5,664,451 | A | 9/1997 | Schultz | |
| 5,732,585 | A | 3/1998 | Haushahn et al. | |
| 5,826,454 | A * | 10/1998 | Kohnen | 72/117 |
| 6,233,995 | B1 | 5/2001 | Cleave et al. | |
| 7,290,423 | B2 * | 11/2007 | Carsley et al. | 72/214 |

* cited by examiner

*Primary Examiner*—Edward Tolan
(74) *Attorney, Agent, or Firm*—Howard & Howard Attorneys PLLC

(57) ABSTRACT

A portable hand tool includes a frame for guiding a sheet of material, e.g., sheet metal. A pair of shafts are spaced from each other and are selectively slideable relative to the frame to define a plurality of adjustment positions. A pair of rollers are respectively mounted to the shafts for deforming the sheet of material between the rollers. An adjustment rod is mounted to and extends outwardly from the frame. A support interconnects the shafts and an adjustment device is rotatably engaged with the support. A coupling device is disposed about the adjustment rod and is moveable between an engaged position and a disengaged position. In the engaged position, the coupling device couples the adjustment rod and the adjustment device to lock the shafts and rollers laterally relative to the frame. In the disengaged position, the shafts and rollers are slideable relative to the frame between the adjustment positions.

21 Claims, 5 Drawing Sheets

PORTABLE HAND TOOL

CROSS-REFERENCE TO RELATED APPLICATIONS

The subject patent application claims priority to and all the benefits of U.S. Provisional Patent Application Ser. No. 60/800,759 which was filed on May 16, 2006, the entire specification of which is expressly incorporated herein by reference.

BACKGROUND OF THE INVENTION

1. Field of the Invention

The present invention relates to a portable hand tool, and more specifically a portable hand tool used for deforming a sheet of material such as sheet metal.

2. Description of the Related Art

Various portable hand tools are known in the art for deforming a portion of a sheet of material, e.g., sheet metal. One application for the portable hand tool is for deforming a groove into the sheet of material to form a siding panel for a building. The portable hand tool is sized such that it is easily transported to a site of the building so that the sheet of material is deformed at the site of the building prior to installation onto the building.

The portable hand tool deforms the groove in the sheet of material to strengthen and reinforce the siding panel. The groove reinforces the sheet of material to reduce the tendency of the sheet of material to bend. The groove also eliminates rippling that occurs when a nail is driven through the siding panel to hang the siding panel on the building. Such rippling is referred to by those skilled in the art as "oil canning." Specifically, the nail is driven through the siding panel in the groove and the groove prevents rippling of the sheet beyond the groove. The groove is also aesthetically pleasing.

An example of a portable hand tool is disclosed in U.S. Pat. No. 5,732,585 (the '585 patent) to Haushahn, et al. The '585 patent discloses the portable hand tool having a frame for guiding the sheet of material. First and second shafts are spaced from each other and are selectively slideable relative to the frame to define a plurality of adjustment positions. A first roller is engaged with the first shaft and a second roller is engaged with the second shaft for deforming a portion of the sheet of material between the rollers. The shafts are moved relative to the frame between the adjustment positions to adjust the location of the rollers along the sheet of material, thereby adjusting the location of the groove along the sheet of material. An adjustment rod is mounted to the frame and extends outwardly from said frame. A support interconnects and is fixed in position relative to the shafts and an adjustment device is rotatably engaged with the support for movement with the shafts relative to the adjustment rod between the adjustment positions. Specifically, the adjustment rod defines external threads and the adjustment device defines internal threads receiving the external threads of the adjustment device.

To adjust the location of the groove to be formed on the sheet of material, the adjustment device is rotated to move the internal threads of the adjustment device relative to the exterior threads of the adjustment rod to translate the adjustment device relative the adjustment rod. As such, the support and the shafts move laterally relative to the frame. As the shafts move laterally, the rollers move laterally relative to the frame.

Notably, the threaded interaction between the external threads of the adjustment rod and the internal threads of the adjustment device provides the only mode of movement between the adjustment positions. In other words, the translation of the adjustment device associated with the movement of the internal threads relative to the external threads adjusts the position of the rollers relative to the frame. As such, when the rollers must be moved a relatively long distance between adjustment positions, the adjustment device must be rotated several turns to make such a relatively large adjustment. Such an adjustment that requires several turns of the adjustment device is ergonomically unsatisfactory and is disadvantageously time consuming.

Accordingly, it would be advantageous to design a portable hand tool that allows for quick adjustments of the shafts and rollers between adjustment positions, i.e., adjustment of the rollers relative to the frame.

SUMMARY OF THE INVENTION AND ADVANTAGES

The present invention is a portable hand tool for deforming a portion of a sheet of material. The portable hand tool includes a frame for guiding the sheet of material. First and second shafts are spaced from each other and are selectively slideable relative to the frame to define a plurality of adjustment positions. A first roller is engaged with the first shaft and a second roller is engaged with the second shaft for deforming the portion of the sheet of material between the rollers. A support interconnects and is fixed in position relative to the shafts. An adjustment rod is mounted to the frame and extends outwardly from the frame. An adjustment device is rotatably engaged with the support for movement with the shafts relative to the adjustment rod between the adjustment positions. A coupling device is disposed about the adjustment rod and is moveable between an engaged position and a disengaged position. In the engaged position, the coupling device couples the adjustment rod to the adjustment device for fixing the shafts and preventing movement between the adjustment positions to maintain a desired positioning of the rollers. In a disengaged position the coupling device is spaced from the adjustment device for allowing the shafts to slide between the adjustment positions to reposition the rollers.

Accordingly, the coupling device is moved between the engaged and disengaged positions to respectively lock and unlock the rollers relative to the frame. When in the disengaged position, the shafts slide relative to the frame to quickly and easily move the shafts between adjustment positions. When the appropriate adjustment position is located, the coupling device is moved to the engaged position to lock the shafts in place relative to the frame thereby locking the lateral position of the rollers relative to the frame. As such, the location of the rollers relative to the frame is quickly and easily adjusted regardless of the magnitude of adjustment that is required. In other words, an adjustment requiring movement of the rollers over a relatively large distance is quickly and easily achieved by moving the coupling device to the disengaged position and sliding the shafts and the rollers relative the frame.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
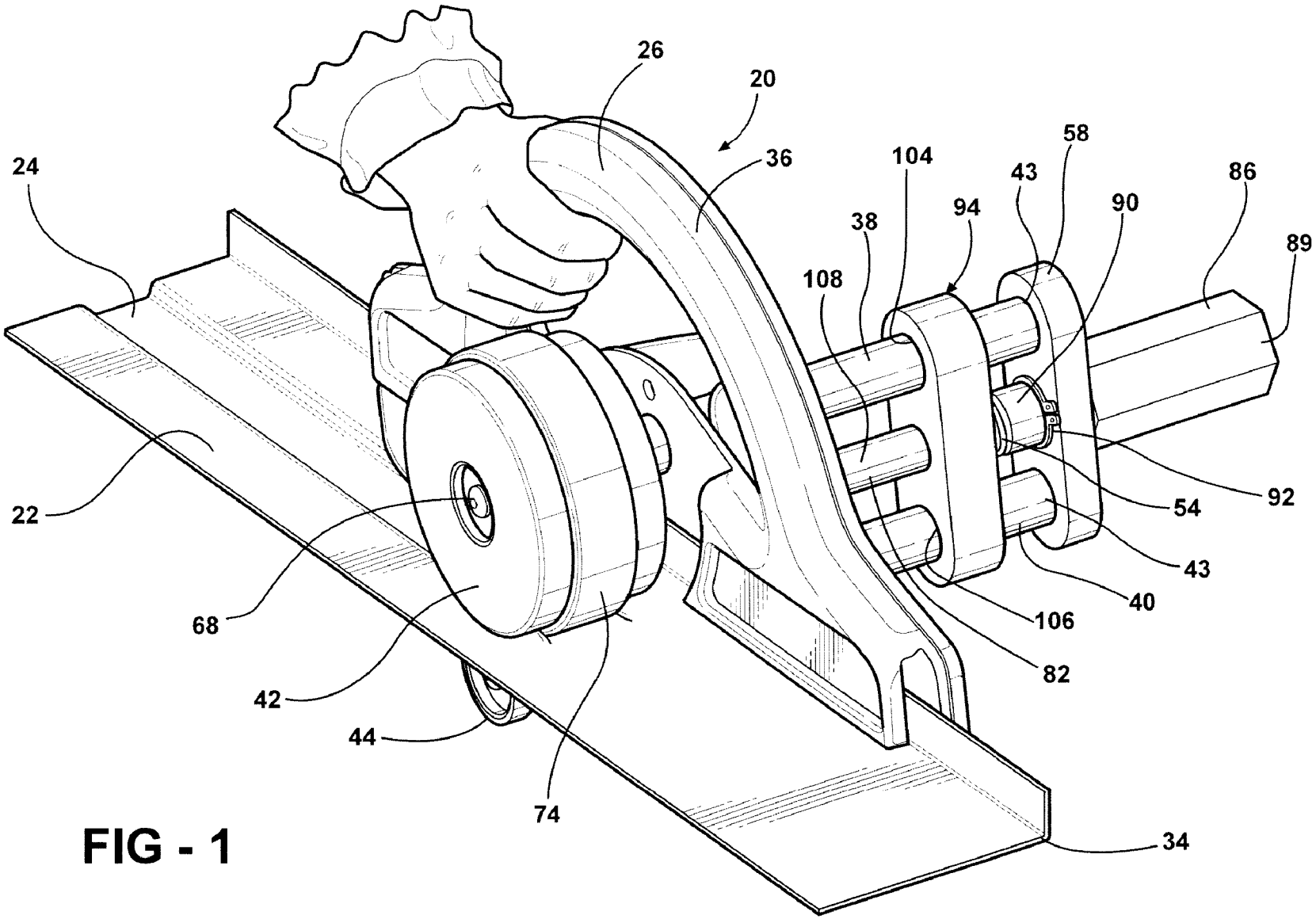
FIG. 1 is a perspective view of a portable hand tool and a sheet of material deformed by the portable hand tool.
Figure 2:
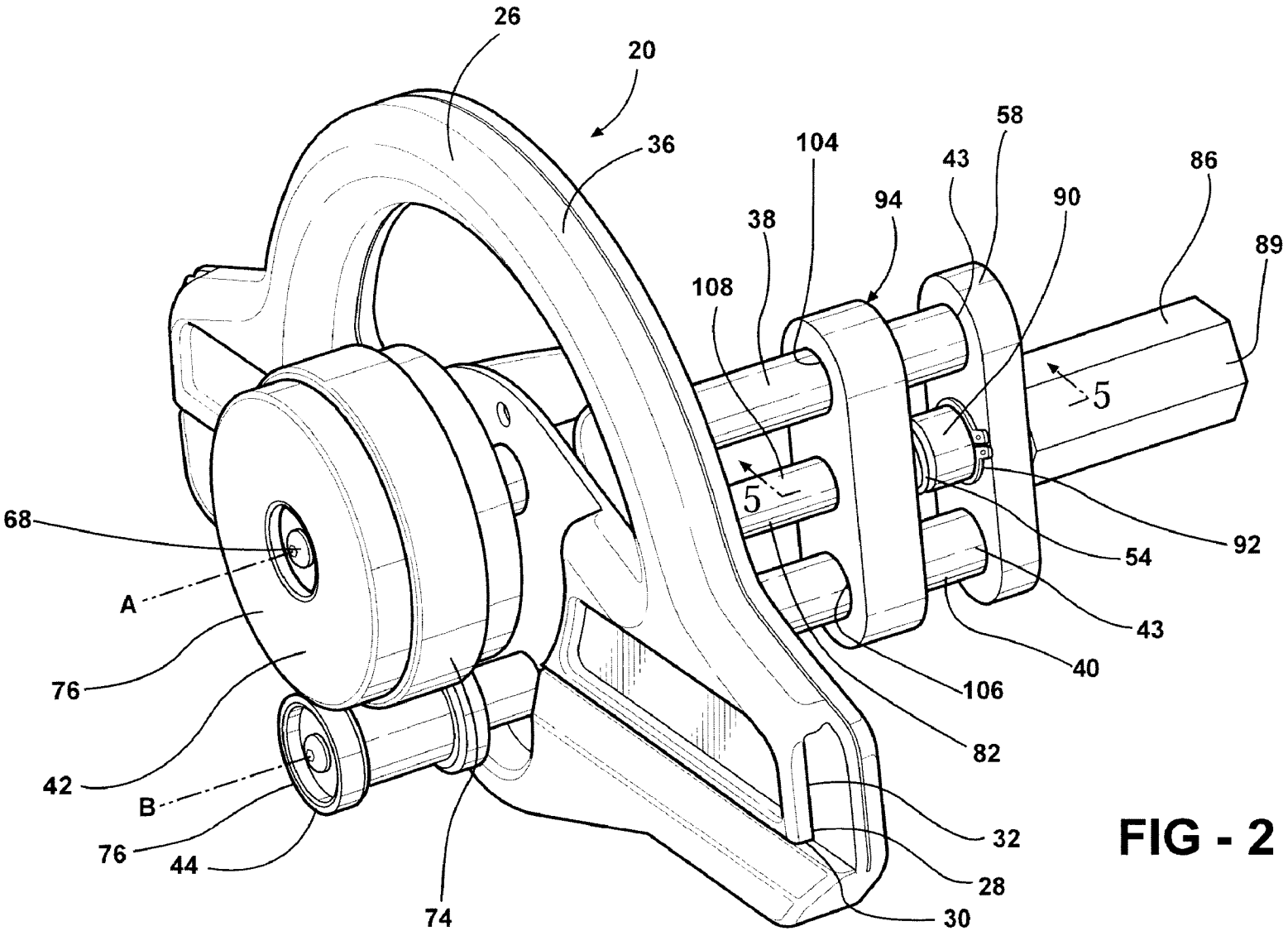
FIG. 2 is a perspective view of the portable hand tool.

Referring to the Figures, wherein like numerals indicate like parts throughout the several views, a portable hand tool 20 is generally shown. As shown in FIG. 1, the portable hand tool 20 deforms a portion of a sheet 22 of material. The portable hand tool 20 of this type may be referred to by those skilled in the art as a brake. For example, the material is a metal such as steel or aluminum and may be used for siding a building such as a commercial or residential building. Specifically, the sheet 22 of material may be formed into a siding panel at the site of the building prior to installation onto the building.

The portable hand tool 20 is used to strengthen and reinforce the siding panel. Specifically, portable hand tool 20 is used to form a groove 24 in the sheet 22 of material. The groove 24 reinforces the sheet 22 of material to reduce the tendency of the sheet 22 of material to bend. The groove 24 also eliminates rippling that occurs when a nail is driven through the siding panel to hang the siding panel on the building, i.e., such rippling is referred to by those skilled in the art as "oil canning." Specifically, the nail is driven through the siding panel in the groove 24 and the groove 24 prevents rippling of the sheet 22 beyond the groove 24. The groove 24 is also aesthetically pleasing. The portable hand tool 20 is shown in FIG. 1 as forming the groove 24 in the sheet 22 of material. It should be appreciated that the portable hand tool 20 may be used to form any shape or pattern of groove 24 or to form a bend in the sheet 22 of material.

The portable hand tool 20 includes a frame 26 for guiding the sheet 22 of material. The frame 26 defines a slot 28 for receiving the sheet 22 of material and for guiding the portable hand tool 20 along the sheet 22 of material, as shown in FIG. 1. The slot 28 includes a first portion 30 and a second portion 32 extending perpendicularly relative to the first portion 30 such that the slot 28 is L-shaped. As such, the slot 28 receives an L-shaped end 34 of the sheet 22 of material. It should be appreciated that the slot 28 may have any shape for receiving and guiding any shape of the sheet 22 of material without departing from the nature of the present invention.

The frame 26 defines a grip 36. The user is able to fit at least one hand onto the grip 36 to exert force on the portable hand tool 20 to move the portable hand tool 20 and the sheet 22 of material relative to each other.

The portable hand tool 20 includes first and second shafts 38, 40 and first and second rollers 42, 44. As will be discussed below, the first and second shafts 38, 40 are selectively slideable relative to the frame 26 to define a plurality of adjustment positions. In other words, the shafts 38, 40 and the rollers 42, 44 move together as a unit relative to the frame 26. As will be discussed below, the groove 24 is formed between the rollers 42, 44 and the adjustment position defines the location of the groove 24 on the sheet 22 of material. The position of the rollers 42, 44 relative to the sheet 22 of material is adjustable between the plurality of adjustment positions so that the location of the groove 24 along the sheet 22 of material may be adjusted.

Figure 3:
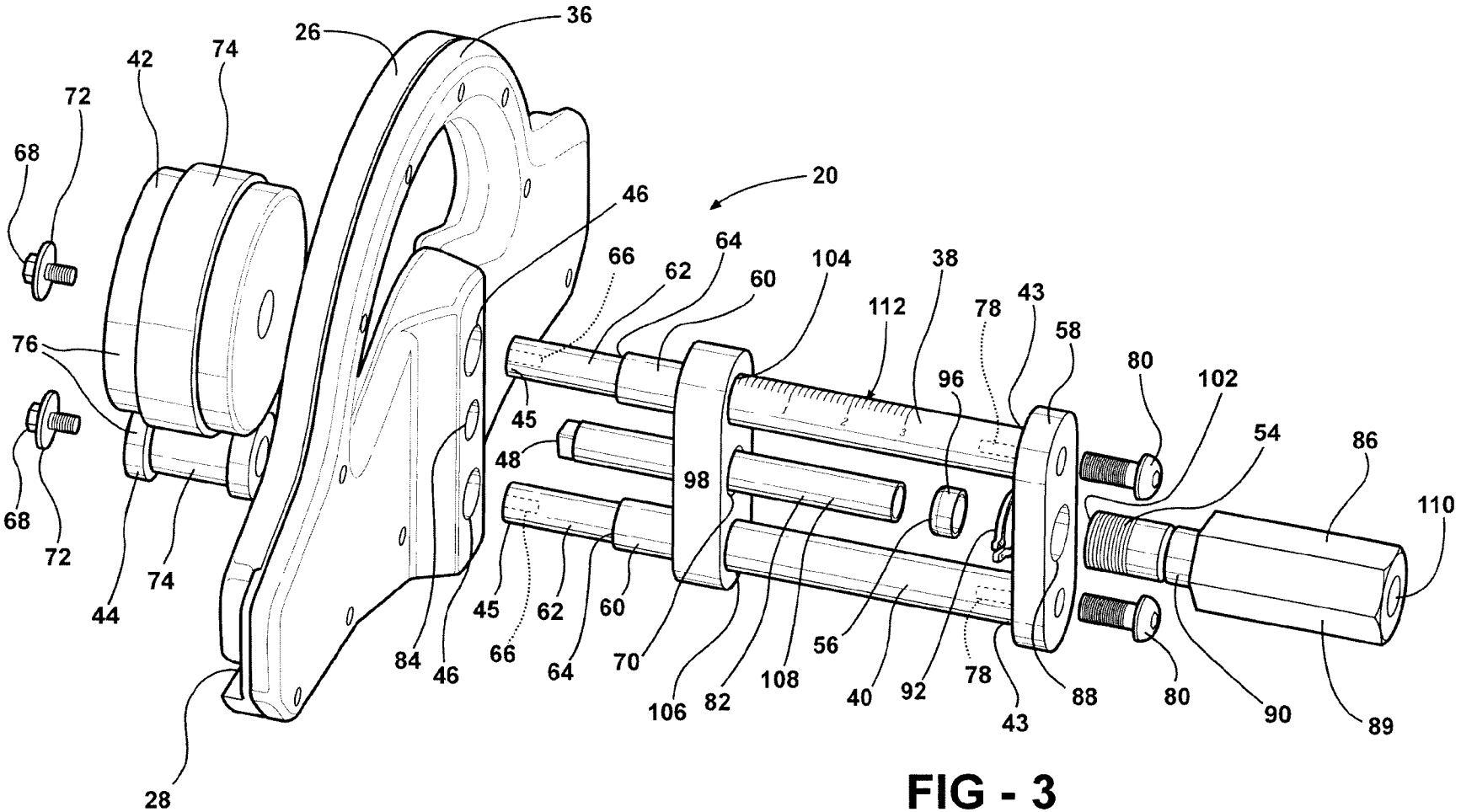
FIG. 3 is a partially exploded view of the portable hand tool.
Figure 4:
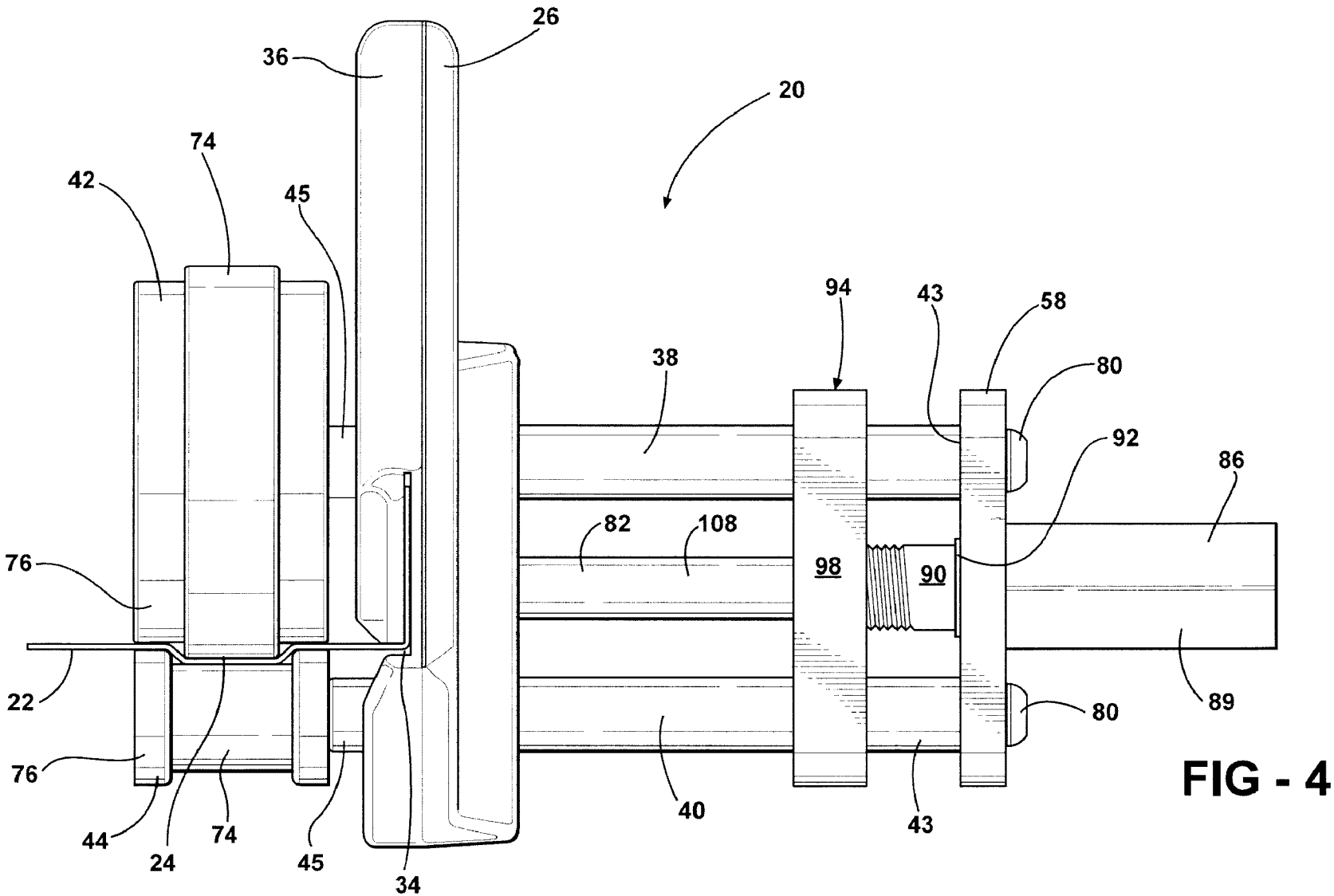
FIG. 4 is a side view of the portable hand tool and the sheet of material deformed by the portable hand tool.

The first and second shafts 38, 40 are spaced from each other. As best shown in FIG. 3, the frame 26 defines a pair of shaft holes 46 with each shaft 38, 40 slideably disposed in one of the shaft holes 46, respectively. Specifically, the shaft holes 46 and the first and second shafts 38, 40 are cylindrical in shape such that the shafts 38, 40 slide in the shaft holes 46 when the shafts 38, 40 are moved between adjustment positions.

The first roller 42 is engaged with the first shaft 38 and the second roller 44 is engaged with the second shaft 40. The first roller 42 rotates about a first axis A and the second roller 44 rotates about a second axis B in parallel with the first axis A for deforming the portion of the sheet 22 of material between the rollers 42, 44. Specifically, the first and second rollers 42, 44 rotate relative to the first and second shafts 38, 40, respectively.

The guide channel of the frame 26 extends perpendicularly to the first and second axes A, B for guiding the sheet 22 of material between the first and second rollers 42, 44. As such, when the sheet 22 of material is disposed in the slot 28 and extends between the rollers 42, 44, the portable hand tool 20 and the sheet 22 of material are moved relative to each other such that the rollers 42, 44 deform the sheet 22 of material.

The first and second shafts 38, 40 each extend between proximate and distal ends 43, 45. The distal end 45 of the first shaft 38 supports 58 the first roller 42 and the distal end 45 of the second shaft 40 supports 58 the second roller 44. As best shown in FIG. 3, each shaft 38, 40 presents a main portion 60 and an axle 62 extending from the main portion 60 at the distal end 45. Each shaft 38, 40 presents a ridge 64 between the main portion 60 and the axle 62. The first roller 42 is disposed on the axle 62 of the first shaft 38 and the second roller 44 is disposed on the axle 62 of the second shaft 40. The shafts 38, 40 each define a threaded hole 66 at the distal end 45. The rollers 42, 44 abut the ridge 64 and a fastening device 68 threadedly engages the threaded hole 66 at the distal end 45 to retain the rollers 42, 44 on the shafts 38, 40, respectively. The fastening device 68 shown in FIG. 3 includes a washer 72 for retaining the rollers 42, 44 on the shafts 38, 40. It should be appreciated that the rollers 42, 44 may be retained to the shafts 38, 40 in any manner without departing from the nature of the present invention.

The first and second rollers 42, 44 are generally cylindrical and each presents a patterned circumferential surface 74 for deforming a pattern in the portion of the sheet 22 of material, e.g., the groove 24. The portable hand tool 20 may be used to form the groove 24 having any of a plurality of shapes and sizes.

Any one of a plurality of sets 76 of rollers 42, 44 may be mounted to the first and second shafts 38, 40. Each set of rollers 42, 44 include the first and second rollers 42, 44 with the rollers 42, 44 of each set having a different patterned circumferential surface 74 than rollers 42, 44 of other sets. In other words, one set of rollers 42, 44 may be removed from the shafts 38, 40 and another set of rollers 42, 44 may be mounted to the shafts 38, 40 to change the pattern of the groove 24 deformed in the sheet 22 of material. Specifically, the fastening devices 68 at the distal ends 45 of the shafts 38, 40 are disengaged from the distal ends 45 of the shafts 38, 40 to remove the set of rollers 42, 44 from the shafts 38, 40 and to place another set of rollers 42, 44 on the shafts 38, 40. As such, the user may choose from any one of the plurality of sets 76 of rollers 42, 44 to form the size and shape of groove 24 as needed.

Figure 5:
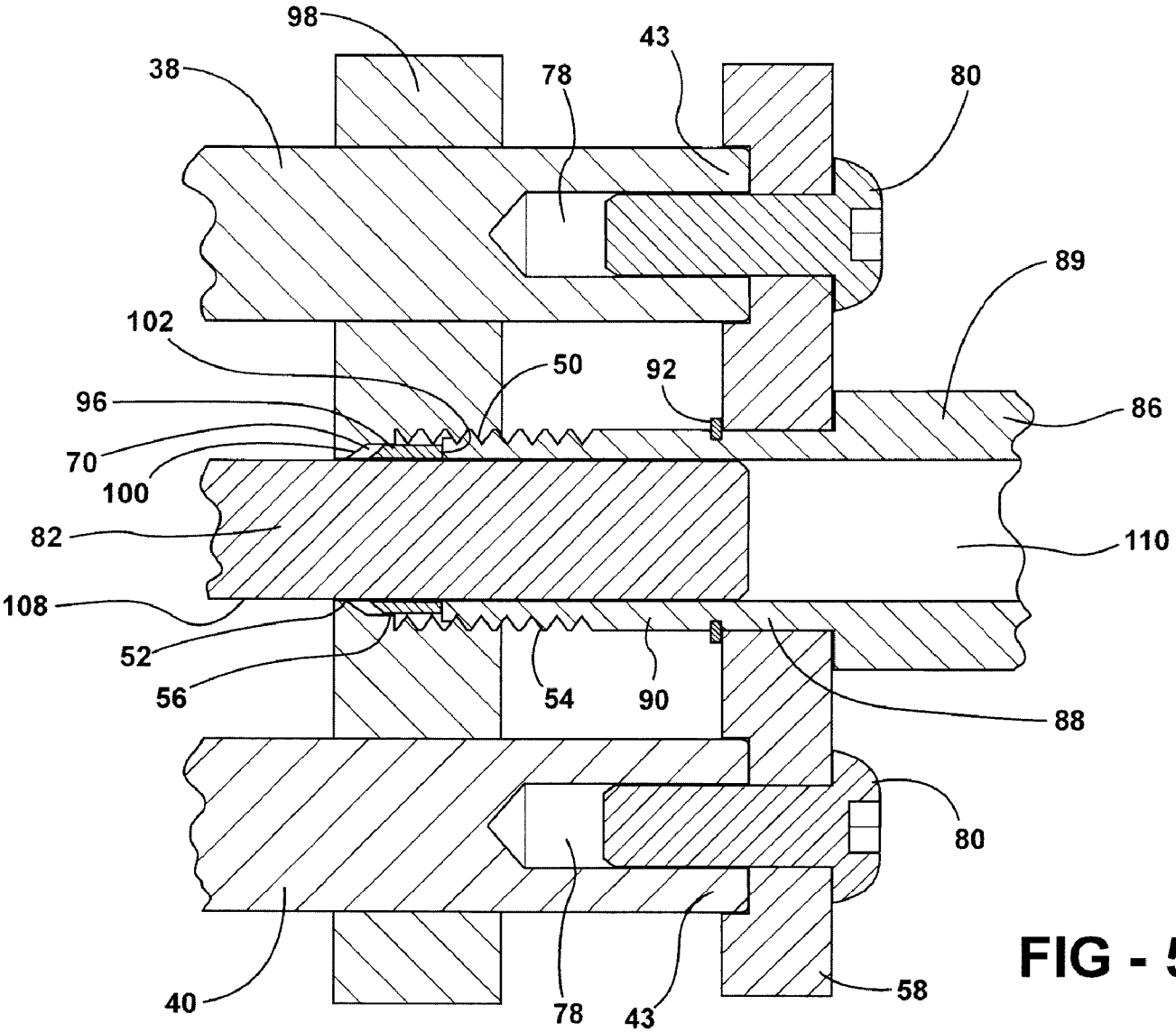
FIG. 5 is a cross-sectional view of a portion of the portable hand tool along line 5-5 of FIG. 1.

A support 58 is interconnected to and fixed in position relative to the shafts 38, 40. Specifically, the proximate ends 43 of the shafts 38, 40 are engaged with the support 58. The support 58 couples the shafts 38, 40 to each other such that the support 58 and the shafts 38, 40 move together as a unit. As best shown in FIG. 5, each of the shafts 38, 40 define a screw hole 78 and a pair of threaded fasteners 80 extend through the support 58 and threadedly engage the screw holes 78 to connect the support 58 to the shafts 38, 40. It should be appreciated that the support 58 and the shafts 38, 40 may be connected in any manner without departing from the nature of the present invention. Alternatively, the support 58 and the shafts 38, 40 are integrally formed as a one-piece unit.

As shown in FIGS. 1-4, an adjustment rod 82 is mounted to the frame 26 and extends outwardly from the frame 26. As best shown in FIG. 3, the frame 26 defines an engagement hole 84 and the adjustment rod 82 includes an engagement end 48 disposed in the engagement hole 84. For example, the engagement end 48 is square-shaped and the engagement hole 84 corresponds to the engagement end 48 to prevent rotation of the adjustment rod 82 relative to the frame 26. The engagement hole 84 is defined in the frame 26 between the pair of shaft holes 46.

An adjustment device 86 is rotatably engaged with the support 58 for movement with the shafts 38, 40 relative to the adjustment rod 82 between the adjustment positions. In other words, the adjustment device 86 and the support 58 move together as a unit.

As best shown in FIG. 3, the support 58 defines an aperture 88. The adjustment device 86 includes a handle 89 and an extension 90 with the extension 90 rotatably coupled to the support 58 in the aperture 88. The extension 90 extends from the handle 89 through and beyond the aperture 88. A snap ring 92 is positioned along and engaged to the extension 90 opposite the support 58 from the handle 89 for rotatably engaging the adjustment device 86 to the support 58 in the aperture 88. Specifically, the extension 90 defines a notch about the circumference of the extension 90 and the snap ring 92 is disposed in the notch and engages the extension 90 in the notch.

As shown in FIGS. 3 and 5, a coupling device 94 is disposed about the adjustment rod 82. The adjustment device 86 is moveable between an engaged position and a disengaged position. In the engaged position, the adjustment rod 82 is coupled to the adjustment device 86 for fixing the shafts 38, 40 and preventing movement between the adjustment positions to maintain a desired positioning of the rollers 42, 44. In the disengaged position the adjustment device 86 is spaced from the adjustment rod 82 for allowing the shafts 38, 40 to slide between the adjustment positions to reposition the rollers 42, 44. In other words, in the engaged position the shafts 38, 40 are fixed in position relative to the frame 26 so that the rollers 42, 44 are disposed a fixed distance from frame 26 to deform the sheet 22 of material at the fixed distance. In the disengaged position, the shafts 38, 40 are slideable relative to the frame 26 so that the position of the rollers 42, 44 may be adjusted relative to the frame 26. As such, when the rollers 42, 44 are moved to a desired position relative the frame 26, the adjustment device 86 is moved to the engaged position to maintain that position.

The coupling device 94 includes a collet 96 and a locking plate 98 disposed on the adjustment rod 82. The collet 96 engages the adjustment rod 82 in the engaged position and slides relative to the adjustment rod 82 in the disengaged position. Specifically, the locking plate 98 defines a hole 70 with the adjustment rod 82 disposed in the hole 70. The adjustment device 86 and the collet 96 are disposed in the hole 70 at the engaged position to prevent movement between the adjustment positions. In other words, in the engaged position the adjustment device 86 engages the locking plate 98 and the collet 96 engages the adjustment rod 82 such that the adjustment device 86 and the adjustment rod 82 are coupled to each other and immoveable relative to each other. It should be appreciated that the coupling device 94 may be any type of coupling device that couples the adjustment rod 82 and the adjustment device 86 for preventing movement of the shafts 38, 40 between the adjustment positions. For example, in an alternative to or in addition to the collet 96 and locking plate 98, the coupling device may include a cam lock mechanism for coupling the adjustment rod 82 and the adjustment device 86.

More specifically, as shown in FIG. 5, the locking plate 98 defines a ramp 100 in the hole 70. The ramp 100 is configured to compress the collet 96 into engagement with the adjustment rod 82 between the ramp 100 and the adjustment device 86 when in the engaged position. The hole 70 includes a first end 50 and a second end 52 having a smaller diameter than the first end 50. The ramp 100 extends between the first end 50 and the second end 52. Notably, FIG. 5 shows the coupling device 94 in the disengaged position. The coupling device 94 is moved to the engaged position by moving the adjustment device 86 toward the collet 96 to move the collet 96 toward the ramp 100 thereby compressing the collet 96 onto the adjustment rod 82.

As shown in FIG. 5, the locking plate 98 defines threads in the first end 50 of the hole 70. The adjustment device 86 includes a threaded end 54 moveable along the threads for compressing the collet 96 between the adjustment device 86 and the ramp 100 in the engaged position. Specifically, the extension 90 includes the threaded end 54 and the threaded end 54 threadedly engages the hole 70. In such a configuration, the coupling device 94 is moved between the engaged position and the disengaged position by rotating the adjustment device 86 in the first end 50 of the hole 70 to move the collet 96 into and out of engagement with the ramp 100. As such, a relatively minor rotation of the adjustment device 86 decouples the coupling device 94, the adjustment device 86, and the adjustment rod 82 such that the adjustment shafts 38, 40 are free to slide between the adjustment positions. Likewise, a relatively minor rotation of the adjustment device 86 couples the coupling device 94, the adjustment device 86, and the adjustment rod 82 such that the adjustment shafts 38, 40 are locked in an adjustment position, i.e., the rollers 42, 44 are fixed laterally relative to the frame 26.

The collet 96 includes a tapered end 56 facing the ramp 100 of the locking plate 98 for mating with the ramp 100 to compress the collet 96 on the adjustment rod 82. As the adjustment device 86 moves the collet 96 toward the ramp 100, the tapered end 56 rides against the ramp 100 and the ramp 100 guides the tapered end 56 such that the collet 96 is compressed onto the adjustment rod 82.

The extension 90 presents an end surface 102 configured to force the collet 96 against the locking plate 98 in the hole 70 for engaging the collet 96 with the adjustment rod 82 when in the engaged position. The end surface 102 is planar and a surface of the collet 96 that abuts the end surface 102 is planar. When the adjustment device 86 is moved toward the collet 96, the end surface 102 exerts force against the collet 96 to push the collet 96 toward the ramp 100.

The locking plate 98 defines a first and second opening 104, 106 with the first opening 104 slideably receiving the first shaft 38 and with the second opening 106 slideably receiving the second shaft 40. The first and second openings 104, 106 are cylindrical in shape for slideably receiving the first and second shafts 38, 40. When the coupling device 94 is in the disengaged position, the first and second shafts 38, 40 are slideable in the first and second openings 104, 106, respectively.

The adjustment rod 82 is cylindrical and presents a smooth surface 108 and the collet 96 is annularly shaped. The collet 96 receives the adjustment rod 82 and is slideable along the smooth surface 108 during movement between the adjustment positions.

As shown in FIG. 5, the adjustment device 86 defines a through-bore 110 slideably receiving the adjustment rod 82 for allowing the adjustment rod 82 to extend from and retract into the through-bore 110 during movement between the adjustment positions. In other words, as the support 58 is moved toward the frame 26, the adjustment rod 82 remains stationary relative to the frame 26 and retracts into the through-bore 110. Likewise, as the support 58 is moved away from the frame 26, the adjustment rod 82 remains stationary relative to the frame 26 and extends from the through-bore 110.

The first and second shafts 38, 40 and the adjustment rod 82 extend in parallel with each other. As such, in the disengaged position the locking plate 98 is slideable along the first and second shafts 38, 40 and the adjustment rod 82 without binding with any of the first and second shafts 38, 40 and the locking plate 98.

One of the first and second shafts 38, 40 presents measuring indicia 112 for measuring movement between the adjustment positions. Specifically, as shown in FIG. 3, the measuring indicia 112 are further defined as tick marks on the first shaft 38. The tick marks are referenced against the frame 26 at the shaft hole 46. The user may refer to the tick marks to adjust the first and second shafts 38, 40 to a predetermined adjustment position. For example, the tick marks may correspond to measuring units such as inches or millimeters.

The method of adjusting the portable hand tool 20 enables the rollers 42, 44 to be moved between the adjustment positions to adjust the position of the groove 24 in the sheet 22 of material. Specifically, the first and second shafts 38, 40 are slideably adjusted relative to the frame 26 to move between adjustment positions.

The adjustment device 86 is moved to the disengaged position by rotating the handle 89 counterclockwise to allow the threaded end 54 of the extension 90 to relieve pressure on the collet 96. The collet 96 moves away from the ramp 100 of the hole 70 to relieve compression on the adjustment shaft. This action allows the first and second shafts 38, 40 to move freely which allows the distance between the rollers 42, 44 and the frame 26 to be changed, i.e., moving between the adjustment positions. As such, the shafts 38, 40 are quickly adjustable between adjustment position by merely rotating the adjustment device, which frees the shafts 38, 40 to be slideable relative to the frame 26. The first and second shafts 38, 40 are adjusted to any adjustment position desired, i.e., the rollers 42, 44 are adjusted to the appropriate distance away from the frame 26. The user may refer to the measuring indicia 112 on the first shaft 38 to select the desired adjustment position. For example, the adjustment device 86 may be moved between the engaged and disengaged positions with a ¼ turn of the adjustment device 86, i.e. a 90° rotation.

To increase the distance between the rollers 42, 44 and the frame 26, the adjustment device 86 is pushed laterally toward the frame 26 when in the disengaged position, which moves the support 58 toward the frame 26. This action slides the first and second shafts 38, 40 through the pair of shaft holes 46 to move the rollers 42, 44 away from the frame 26.

To decrease the distance between the rollers 42, 44 and the frame 26, the adjustment device 86 is pulled laterally away from the frame 26 when in the disengaged position, which moves the support 58 away from the frame 26. This action slides the first and second shafts 38, 40 through the pair of shaft holes 46 to move the rollers 42, 44 toward the frame 26.

Once the desired adjustment position is located, the adjustment device 86 is rotated clockwise to lock the rollers 42, 44 in the adjustment position. When the adjustment device 86 is rotated clockwise, the threaded end 54 of the extension 90 pushes the collet 96 into the ramp 100 portion of the hole 70. This action compresses the collet 96 around the adjustment rod 82 to lock the adjustment device 86 to the adjustment rod 82 to prevent lateral movement of the first and second shafts 38, 40, which consequently prevents lateral movement of the rollers 42, 44 relative to the frame 26.

The invention has been described in an illustrative manner, and it is to be understood that the terminology which has been used is intended to be in the nature of words of description rather than of limitation. Obviously, many modifications and variations of the present invention are possible in light of the above teachings, and the invention may be practiced otherwise than as specifically described.

What is claimed is:

1. A portable hand tool for deforming a portion of a sheet of material, said portable hand tool comprising:
- a frame for guiding the sheet of material;
- a first and second shaft spaced from each other and selectively slideable relative to said frame to define a plurality of adjustment positions;
- a first and second roller with said first roller engaged with said first shaft and with said second roller engaged with said second shaft for deforming the portion of the sheet of material between said rollers;
- a support interconnecting and fixed in position relative to said shafts;
- an adjustment rod mounted to said frame and extending outwardly from said frame;
- an adjustment device rotatably engaged with said support for movement with said shafts relative to said adjustment rod between said adjustment positions; and
- a coupling device disposed about said adjustment rod and moveable between an engaged position coupling said adjustment rod to said adjustment device for fixing said shafts and preventing movement between said adjustment positions to maintain a desired positioning of said rollers and a disengaged position spaced from said adjustment device for allowing said shafts to slide between said adjustment positions to reposition said rollers.

2. The portable hand tool as set forth in claim 1 wherein said coupling device includes a collet disposed on said adjustment rod with said collet engaging said adjustment rod in said engaged position and sliding relative to said adjustment rod in said disengaged position.

3. The portable hand tool as set forth in claim 2 wherein said coupling device further includes a locking plate defining a hole with said adjustment rod disposed in said hole.

4. The portable hand tool as set forth in claim 3 wherein said adjustment device and said collet are disposed in said hole at the engaged position to prevent movement between said adjustment positions.

5. The portable hand tool as set forth in claim 3 wherein said locking plate defines a ramp in said hole with said ramp configured to compress said collet into engagement with said adjustment rod between said ramp and said adjustment device when in said engaged position.

6. The portable hand tool as set forth in claim 5 wherein said hole includes a first end and a second end having a smaller diameter than said first end with said ramp extending between said first end and said second end.

7. The portable hand tool as set forth in claim 6 wherein said locking plate defines threads in said first end of said hole and wherein said adjustment device includes a threaded end moveable along said threads for compressing said collet between said adjustment device and said ramp in said engaged position.

8. The portable hand tool as set forth in claim 3 wherein said collet includes a tapered end facing said ramp of said locking plate for mating with said ramp to compress said collet on said adjustment rod.

9. The portable hand tool as set forth in claim 3 wherein said locking plate defines a first and second opening with said first opening slideably receiving said first shaft and with said second opening slideably receiving said second shaft.

10. The portable hand tool as set forth in claim 9 wherein said first and second shafts are cylindrical in shape and wherein said first and second openings are cylindrical in shape for slideably receiving said first and second shafts.

11. The portable hand tool as set forth in claim 3 wherein said support defines an aperture and wherein said adjustment device includes a handle and an extension with said extension rotatably coupled to said support in said aperture.

12. The portable hand tool as set forth in claim 11 wherein said extension includes a threaded end threadedly engaging said hole.

13. The portable hand tool as set forth in claim 11 wherein said extension presents an end surface configured to force said collet against said locking plate in said hole for engaging said collet with said adjustment rod when in said engaged position.

14. The portable hand tool as set forth in claim 11 further including a snap ring positioned along and engaged to said extension opposite said support from said handle for rotatably engaging said adjustment device to said support in said aperture.

15. The portable hand tool as set froth in claim 2 wherein said adjustment rod is cylindrical and presents a smooth surface and wherein said collet is annularly shaped with said collet receiving said adjustment rod and slideable along said smooth surface during movement between said adjustment positions.

16. The portable hand tool as set forth in claim 1 wherein said adjustment device defines a through-bore slideably receiving said adjustment rod for allowing said adjustment rod to extend from and retract into said through-bore during movement between said adjustment positions.

17. The portable hand tool as set forth in claim 1 wherein said first roller rotates about a first axis and said second roller rotates about a second axis in parallel with said first axis and wherein said frame defines a guide channel extending perpendicularly to said first and second axes for guiding the sheet of material between the first and second rollers.

18. The portable hand tool as set forth in claim 1 wherein said first and second shafts each extend between proximate and distal ends with said proximate ends of said shafts engaged with said support and with said distal end of said first shaft supporting said first roller and said distal end of said second shaft supporting said second roller.

19. The portable hand tool as set forth in claim 1 wherein said first and second rollers are generally cylindrical and each presents a patterned circumferential surface for deforming a pattern in the portion of the sheet of material.

20. The portable hand tool as set forth in claim 1 wherein said first and second shafts and said adjustment rod extend in parallel with each other.

21. The portable hand tool as set forth in claim 1 wherein one of said first and second shafts presents measuring indicia for measuring movement between said adjustment positions.

* * * * *